US010206833B2

(12) United States Patent
Huang

(10) Patent No.: US 10,206,833 B2
(45) Date of Patent: Feb. 19, 2019

(54) ASSIST CHAIR

(71) Applicant: National Taipei University of Technology, Taipei OT (TW)

(72) Inventor: Chi-Wu Huang, Taipei (TW)

(73) Assignee: National Taipei University of Technology, Taipei (TW)

( * ) Notice: Subject to any disclaimer, the term of this patent is extended or adjusted under 35 U.S.C. 154(b) by 0 days.

(21) Appl. No.: 15/630,138

(22) Filed: Jun. 22, 2017

(65) Prior Publication Data

US 2018/0085266 A1 Mar. 29, 2018

(30) Foreign Application Priority Data

Sep. 26, 2016 (TW) ..... 105130988 A

(51) Int. Cl.
*A61G 5/14* (2006.01)
*A61G 5/10* (2006.01)
*A61G 5/12* (2006.01)

(52) U.S. Cl.
CPC ..... *A61G 5/14* (2013.01); *A61G 5/1045* (2016.11); *A61G 5/125* (2016.11)

(58) Field of Classification Search
CPC ..... A61G 5/14; A61G 5/1045; A61G 5/1059
USPC ..... 297/183.1–183.4
See application file for complete search history.

(56) References Cited

U.S. PATENT DOCUMENTS 4,929,022 A * 5/1990 Geraci ..... A61G 5/14 297/183.9
6,702,383 B2 * 3/2004 Newman ..... A61G 5/14 297/313
6,754,917 B1 * 6/2004 Rhoades ..... A61G 7/1007 4/667
7,021,713 B2 * 4/2006 Kao ..... A61G 5/14 297/338
9,861,542 B2 * 1/2018 Christian ..... A61G 5/14
2002/0101103 A1 * 8/2002 Johnston ..... A61G 5/14 297/330
2006/0284462 A1 * 12/2006 Cheng ..... A61G 5/14 297/326
2015/0202102 A1 * 7/2015 Dunham ..... A61G 5/1059 297/344.13
2016/0067125 A1 * 3/2016 Splane, Jr. ..... A47K 13/105 297/250.1
2016/0128482 A1 * 5/2016 Wallace ..... A47C 1/06 297/183.1
2016/0206099 A1 * 7/2016 Robertson ..... A47C 1/03294
(Continued)

FOREIGN PATENT DOCUMENTS

TW 20090208340 U 5/2009
TW 20110223652 U 6/2012
TW 20140135640 2/2016

*Primary Examiner* — Mark R Wendell

(74) *Attorney, Agent, or Firm* — Schmeiser, Olsen & Watts, LLP

(57) ABSTRACT

An assist chair includes a base portion, a pair of armrests, a backrest, an uplifting apparatus, a seat cushion and a waist rest cushion, wherein the uplifting apparatus further includes a pair of assist handles. When the uplifting apparatus is activated, the assist handles is capable of being driven out of inner sides of the pair of armrests, leaving the inner sides of the armrests or being retracted back to the inner sides of the pair of armrests after being pushed out of the armrests, such that the configuration can support the elderly when standing up or sitting down.

7 Claims, 9 Drawing Sheets

(56) References Cited

U.S. PATENT DOCUMENTS

2016/0310334 A1* 10/2016 Bliem ..... A61G 5/1059
2018/0078434 A1* 3/2018 Christian ..... A61G 5/125

* cited by examiner

ASSIST CHAIR

CROSS REFERENCE TO RELATED APPLICATION

This application claims the priority benefit of Taiwan application serial no. 105130988, filed on 26 Sep. 2016. The entirety of the above-mentioned patent application is hereby incorporated by reference herein and made a part of this specification.

BACKGROUND OF THE INVENTION

This invention is related to an assist chair, and more specifically related to an assist chair with standing up and sitting down assisting functions.

RELATED ART

Based on the research report, the population structure in certain countries are aging at a high rate, leading to fast increasing aged population, and certain countries already stepped into the status of the aged society, wherein some countries are transforming into the hyper aged society with over 20% of their population is over 65 years old. Arriving at that time, there will be more elders needed our care and concern. Therefore, to face the upcoming aging society, there will be more elders taking their daily live themselves, and the most important basic activity in their daily live is standing up and sitting down, wherein many elders can accidently tumble down when standing up and sitting down.

In the present environment, there have been diverse assist equipments assisting the elderly with standing up and sitting down, such as assist chair. Although assist chair can save the effort and reduce the tumbling down risk, the assist chairs in the instant market are generally of the type of single high level seat with the appearances obviously showing the features of assist equipments; That reduces the will of the elderly to use such products, and the appearances of the present assist chairs are in harmonious in the living room. On the other hand, sofas are the most common furniture in living rooms, but the sofas have a relatively lower seat level; thus, it is not suitable for the elderly to be seated on; in addition, such design does not conform to the universal design principle. For allowing the elderly to using sofas as other family members, it is necessary to develop a sofa with standing up and sitting down assisting functions.

Therefore, although the inventors have been granted a plurality of patents—Taiwan patent number, M372119, M430212 and I519260—in the field of assist chairs, they are still developing new devices for the convenience of the elderly.

SUMMARY OF THE INVENTION

Holding the virtue of keeping innovating, the inventors devised equipment using assist handles to help the elderly with standing up and sitting down based on the previous technical fundamental and the instant research result. In addition, the devised equipment is more user-friendly and thus satisfies the demand of the elderly. Moreover, the assist handles and the ordinary armrests of the instant invention are separately configured, the assist handles and the uplifting apparatus are redesigned as modules, such that the configuration can be applied on any type of chairs or sofas, benefiting the mass production.

Consequently, the object of the present invention is to provide an assist chair, an assist chair with standing up assisting function by electrical means for example, in order to mitigate the predicaments the elderly meet when standing up and sitting down.

The other object of the instant invention is to provide an assist chair, wherein a modularized uplifting apparatus is used such that it is applicable to be equipped on any types of chairs or sofas in order to solve the problem of mass production.

Another object of the present invention is to provide an assist chair comprising a base portion, a pair of armrests, a backrest and a uplifting apparatus, wherein the uplifting apparatus further comprises a pair of assist handles, and the assist handles are driven out of a inner sides of the armrests, making the assist handles leave for the inner sides of the armrests or retracted back to the inner sides of the armrests after driven out of the inner sides of the armrests when the uplifting apparatus is activated, such that the configuration can share the force exerted by the lower limbs of the elders when standing up and sitting down so as to prevent excessive torque applied on the lower limbs and hence allow the standing-up and sitting-down motion more smooth without the tumbling down situation as well.

Another object of the present invention is to provide an assist chair, wherein the backrest further comprises backrest cushion and headrest cushion, and the above-mentioned uplifting apparatus further comprises a base stand, a seat cushion support, a waist rest support, a push-retracting assembly and a pair of connecting rod assemblies, wherein the base stand is located at a bottom location of the whole assist chair, one side of the seat cushion support is pivotally connected to the base stand, and the waist rest support is connected to another side of the seat cushion support. In addition, the above-mentioned pair of assist handles are disposed at the two sides of the waist rest support, that is, each of the inner sides of the armrests is configured with one of the assist handles. Through the push force and extracting force provided by the push-retracting assembly, the seat cushion of the sofa is elevated or lowered. The rump of the user will touch the elevating seat cushion when sitting down such that tumbling down situation is prevented. As to standing up, a forward elevating seat cushion can assist elders with standing up and reducing the burden of physical body such that the object of assisting the elders with smooth standing up and sitting down is achieved.

Another object of the present invention is to provide an assist chair, wherein the pair of connecting rod assemblies are connected between the base stand and the waist rest support, and the push-retracting assembly is connected between the base stand and the seat cushion support and between the above-mentioned pair of connecting rod assemblies. The seat cushion support is elevated or retracted back by the configuration of the push-retracting assembly and the connecting rod assemblies. In addition, the aforementioned seat cushion is disposed on the seat cushion support, the waist rest cushion is disposed on the waist rest support, and the seat cushion and the waist rest cushion are disposed separately or in connection.

The following detailed description illustrates the specific features and advantages of the present invention in detail. The content suffices to enable any skilled persons in the related art to understand the content of the present invention and realized the invention. Furthermore, according to the disclosure of the present specification, claims and drawings, any skilled persons in the related art can easily understand the related objects and advantages of the instant invention.

DETAILED DESCRIPTION OF THE PREFERRED EMBODIMENTS

Figure 1:
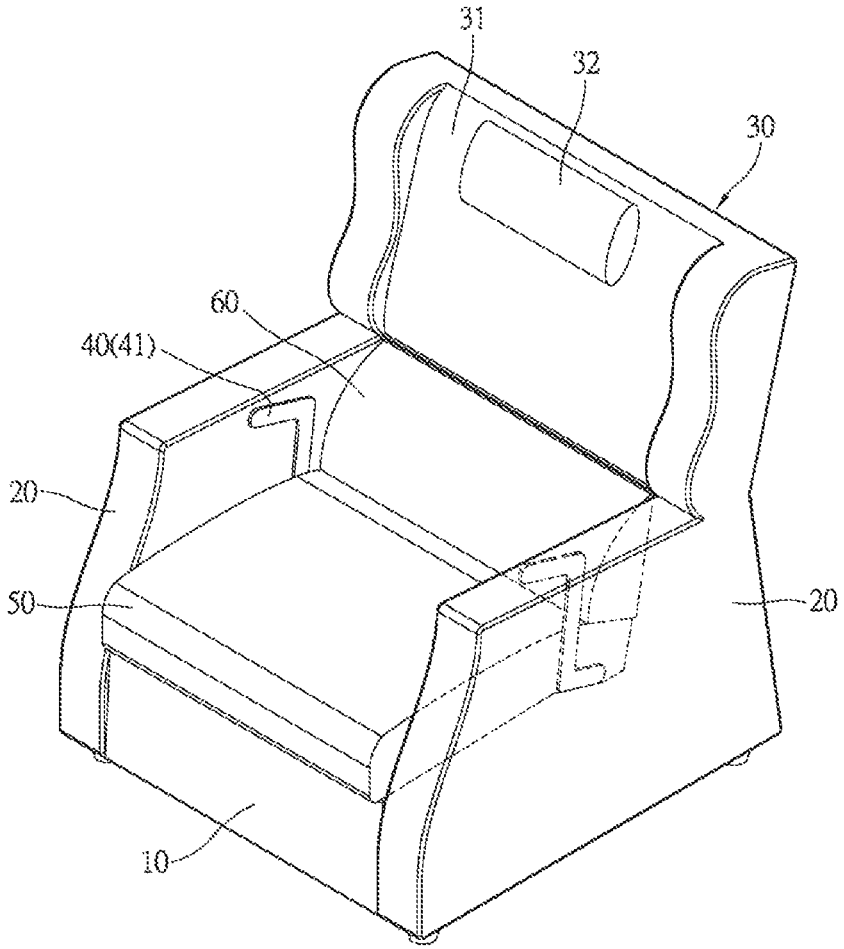
FIG. 1 illustrates the assist chair of the embodiment of the present invention in perspective view.

Please refer to FIG. 1, which illustrates the assist chair of the embodiment of the present invention in perspective view. As shown in the drawing, the assist chair according to the present embodiment comprises body portion 10, a pair of armrests 20, a backrest 30, a uplifting apparatus 40, a seat cushion 50, and a waist rest cushion 60, wherein the uplifting apparatus 40 comprises a pair of assist handles 41, and the backrest 30 further comprises backrest cushion 31 and headrest cushion 32. The aforementioned pair of assist handles 41 are located at inner sides of the pair of armrests 20, that is, each armrest 20 is disposed with one of the assist handles 41. When the uplifting apparatus 40 is activated, the pair of assist handles 41 is pushed out of the inner sides of the armrests 20, making them leave for the inner sides of the armrests 20, or retracted the out-pushed pair of assist handles back to the inner sides of the armrests 20. According to certain embodiments of the instant inventions, the pair of assist handles 41 and the pair of armrests 20 are separately configured, and the pair of assist handles 41 are, for example, in a Z shape.

Figure 2:
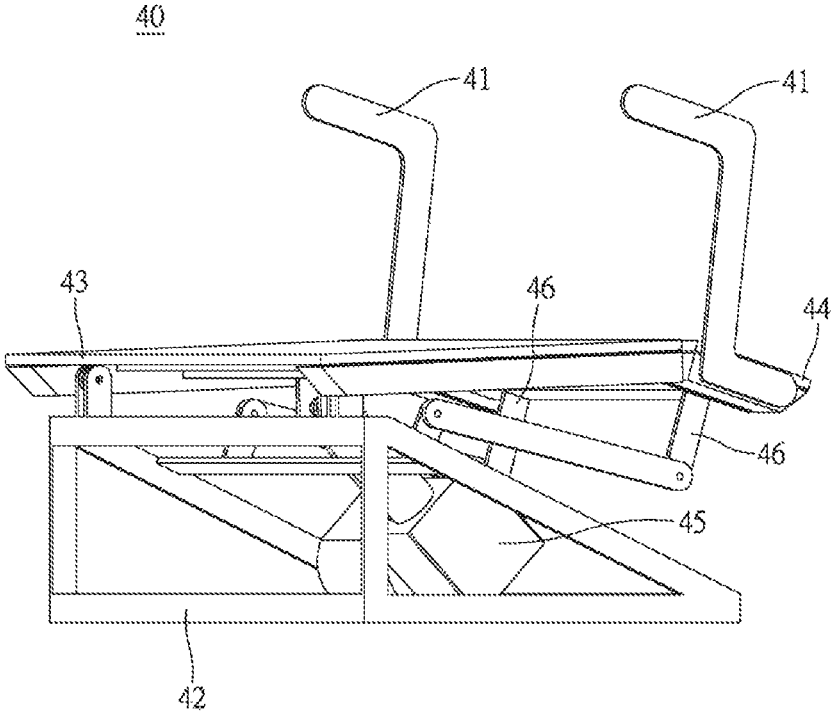
FIG. 2 illustrates the uplifting apparatus of the embodiment of the present invention in first perspective view (deactivated)
Figure 3:
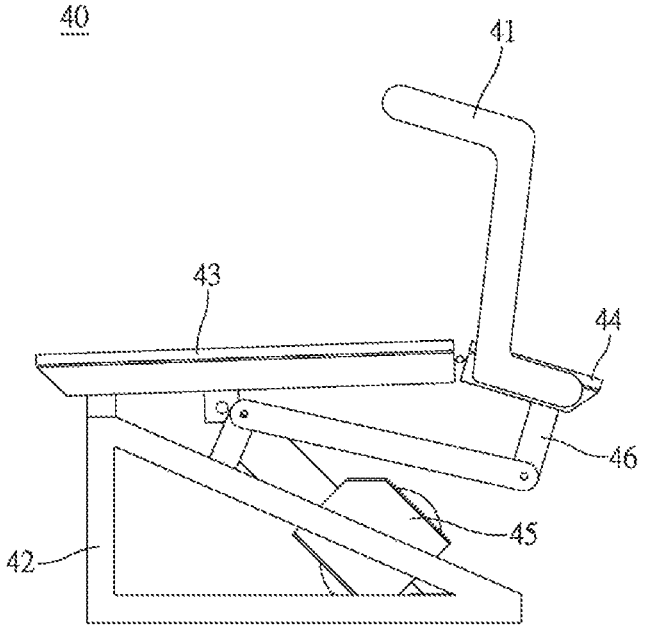
FIG. 3 illustrates the uplifting apparatus of the embodiment of the present invention in first side view (deactivated)

For further elaboration of the present invention, please refer to FIG. 2 and FIG. 3 together, wherein FIG. 2 illustrates the uplifting apparatus of the embodiment of the present invention in first perspective view (deactivated), and FIG. 3 illustrates the uplifting apparatus of the embodiment of the present invention in first side view (deactivated). As shown in the drawings, the aforementioned uplifting apparatus 40 further comprises base stand 42, seat cushion support 43, waist rest support 44, push-retracting assembly 45, and a pair of connection rod assemblies 46, wherein the base stand 42 serves as one of the main support structure of the assist chair, the base stand 42 is located at the bottom location of the whole assist chair, one side of the seat cushion support 43 is pivotally connected to the base stand 42, and the waist rest support 44 is connected to the other side of the seat cushion support 43. In addition, the aforementioned assist handles 41 are disposed on the two sides of the waist rest support 44, that is, each of the two sides of the waist rest support 44 is disposed with one assist handles 41 respectively. According to the present embodiment, the pair of assist handles 41 are used to assist the elderly with standing up and sitting down and especially to reduce the burden of physical body or organs (such as knees), such that the object of assisting the elderly with smooth standing up and sitting down is achieved. Additionally, regarding to the aforementioned push-retracting assembly 45 and the pair of connecting rod assemblies 46 the pair of connecting rod assemblies 46 are connected between the base stand 42 and the waist rest support 44 and located at two sides of the based stand 42 and the waist rest support 44. The push-retracting assembly 45 is connected between the base stand 42 and the seat cushion support 43 and located between the pair of the connecting rod assemblies 46, through which the seat cushion support 43 is elevated or pulled back. It is sequentially noted that the aforementioned seat cushion 50 is disposed on the seat cushion support 43 and the waist rest cushion 60 is disposed on the waist rest stand 44, and the seat cushion 50 and the waist rest cushion 60 might be configured in connection or separately. In addition, the aforementioned backrest 30 further comprises a backrest cushion 31 and a headrest cushion 32, the headrest cushion 32 is disposed on the top of the backrest cushion 31, and a bottom of the backrest cushion 31 is disposed by the waist rest cushion 60.

Figure 4:
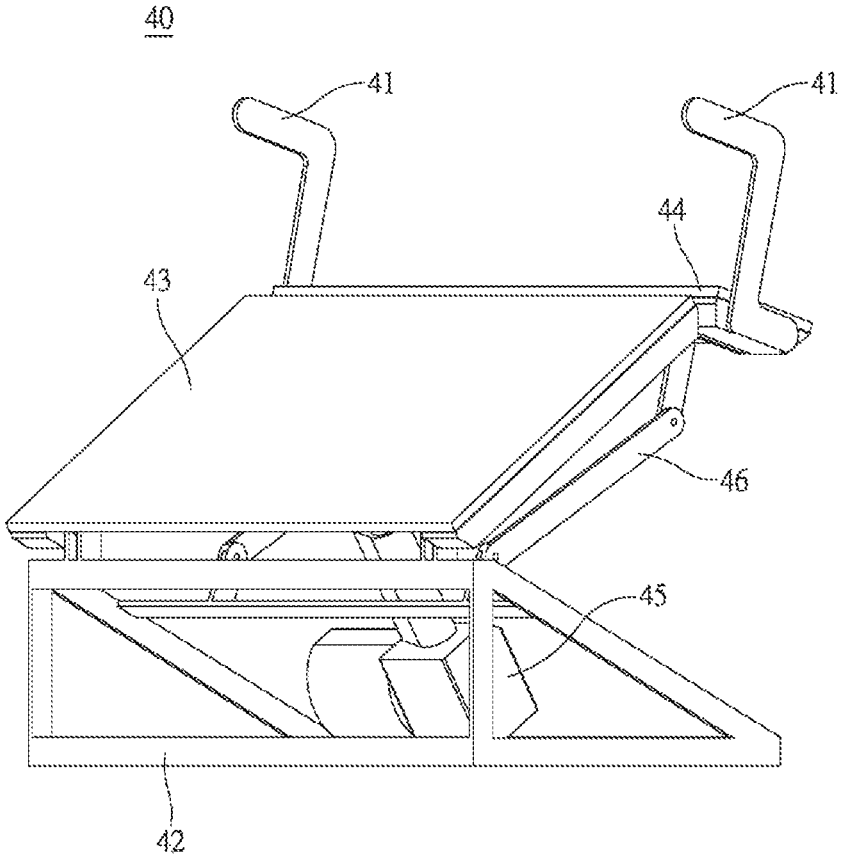
FIG. 4 illustrates the uplifting apparatus of the embodiment of the present invention in second perspective view (activated)
Figure 5:
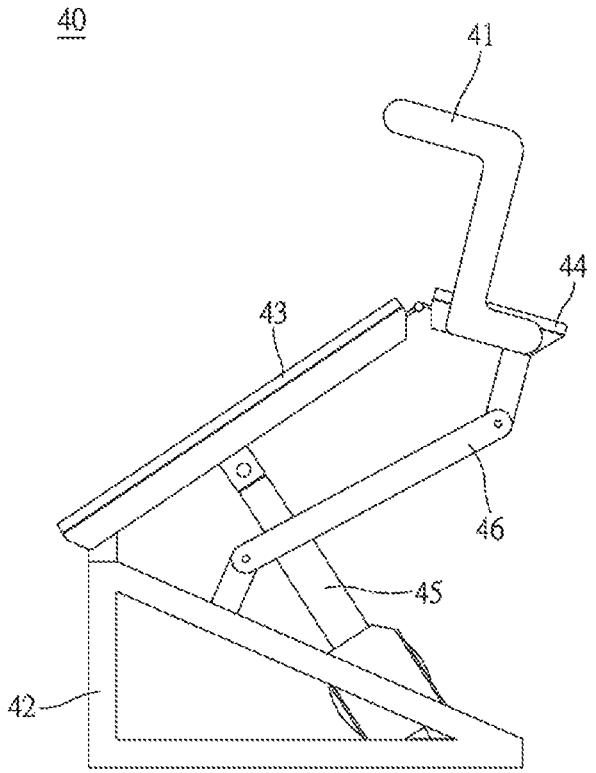
FIG. 5 illustrates the uplifting apparatus of the embodiment of the present invention in second side view (activated)
Figure 6:
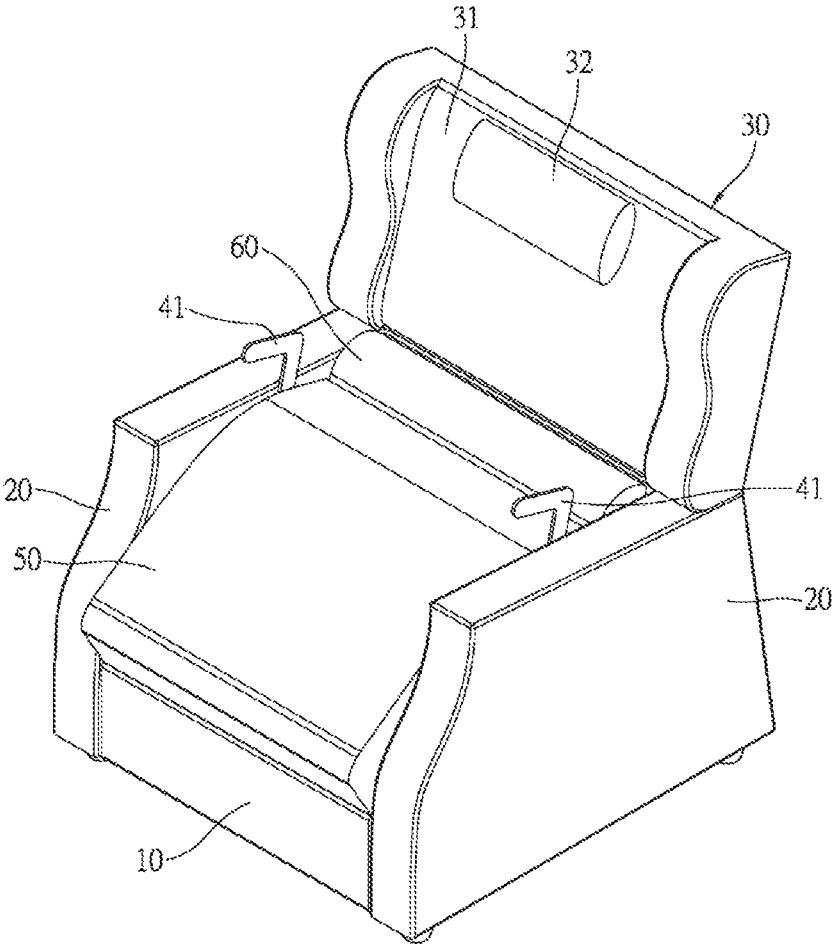
FIG. 6 illustrates the assist chair of the embodiment of the present invention in uplifting operation.

Please refer to FIGS. 4, 5 and 6 together in the following section, wherein FIG. 4 illustrates the uplifting apparatus of the embodiment of the present invention in second perspective view (activated), FIG. 5 illustrates the uplifting apparatus of the embodiment of the present invention in second side view (activated), and FIG. 6 illustrates the assist chair of the embodiment of the present invention in lifting operation; as shown in the drawing, when an elder is using the assist chair of the embodiment of the present invention to stand up and sit down, through the design of the pair of assist handles 41 the elder is assisted with standing up, or the push-retracting assembly 45 of the uplifting apparatus 40 is activated firstly to reduce the burden of the elder's physical body or organs (such as knees). Moreover, since the assist handles 41 of the present invention and the ordinary armrest are configured separately, and the assist handles 41 and the uplifting apparatus 40 are modularly redesigned, the configuration can be applied on any kind of chairs or sofas, benefiting the mass production. When the elderly needs to stand up, the push-retracting assembly 45 of the uplifting apparatus 40 of the present invention is activated firstly to push the seat cushion support 43 to be elevated and at the mean time to drive the waist rest support 44 synchronously to be elevated; at that time the pair of assist handles 41 disposed at the two sides of the waist rest support 44 are gradually pushed out of the inner sides of the pair of armrests 20 since the elevation of the waist rest support 44. Therefore, the elder can used the pair of assist handles 41 to support his body and gradually stand up, and at the mean time the seat cushion 50 disposed on the seat cushion support 43 an the waist rest cushion 60 disposed on the waist rest support 44 also serve as the function of supporting the body to stand up.

Figure 7:
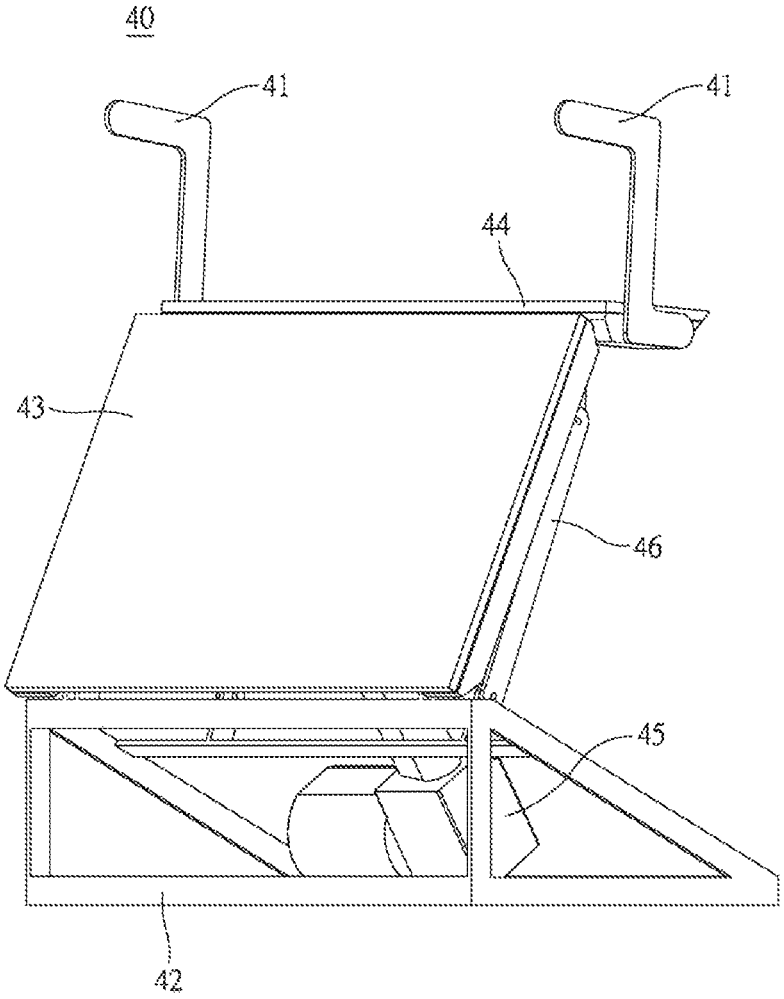
FIG. 7 illustrates the uplifting apparatus of the embodiment of the present invention in third perspective view (uplifting finished)
Figure 8:
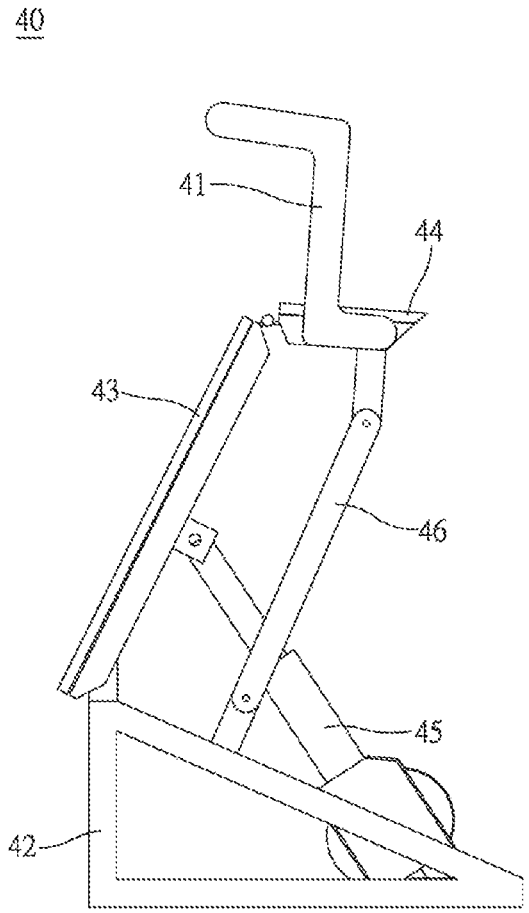
FIG. 8 illustrates the uplifting apparatus of the embodiment of the present invention in third side view (uplifting finished)
Figure 9:
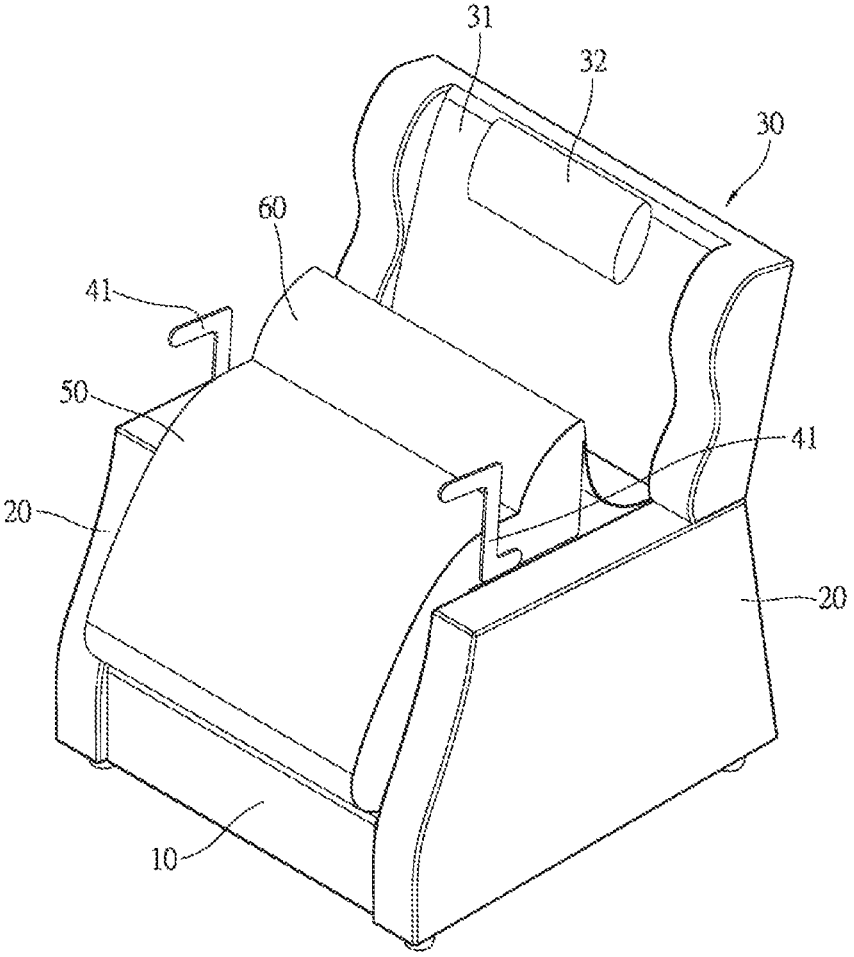
FIG. 9 illustrates the assist chair of the embodiment of the present invention after the uplifting apparatus finishing uplifting.

Please refer to FIGS. 7, 8 and 9, wherein FIG. 7 illustrates the uplifting apparatus of the embodiment of the present invention in third perspective view (uplifting finished), FIG. 8 illustrates the uplifting apparatus of the embodiment of the present invention in third side view (uplifting finished), and FIG. 9 illustrates the assist chair of the embodiment of the present invention after the uplifting apparatus finishing uplifting. As shown in the drawings, after the operation of the push-retracting assembly 45 of the uplifting apparatus 40 of the present invention is finished, the pair of assist handles 41 are fully pushed out of the inner sides of the pair of armrests 20, and the seat cushion 50 on the seat cushion support 43 are fully pushed out of the inner sides of the pair of armrests 20 as well, assisting the elder with finishing the standing posture. Meanwhile, the waist rest cushion 60 disposed on the waist rest support 44 also provides support for the waist, such that the elder can easily and safely, through assisting elevation of the pair of assist handles 41, the seat cushion 50, and the waist rest cushion 60, finish and keep the standing posture in order to finish the standing up motion. With the order reversed, when the elder needs to sit down, he can be assisted through the pair of assist handles 41 supporting his body, and the auxiliary support of the seat cushion 50 and waist rest cushion 60, such that the elder can gradually sit down with support in order to reduce the risk of tumbling down. According to certain embodiments of the instant invention, the pair of assist handles 41 are located out of the inner sides of the pair of armrests 20 after the seat cushion support 43 of the uplifting apparatus 40 is elevated.

In sum, when an elder is using the assist chair of the present invention to assist with standing up and sitting down, through the assisting elevation design of the pair of assist handles 41, seat cushion 50 and waist rest cushion 60 the force exerted by the lower limbs are shared when standing up and sitting down, such that the lower limbers would not endure excessive torque. Therefore, that allows a more smooth standing up and sitting down motion without tumbling down situation.

The present invention is elaborated with aforementioned related embodiments, and however, the aforementioned embodiments are exemplary implementation of the present invention. It should be noted that, the disclosed embodiments do not limit the scope of the present invention. On the contrary, the modifications of the claim scope and equivalent configurations covered by the spirit of the claim scope are covered by the invention scope of the present invention.

What is claimed is:

1. An assist chair, comprising:

a base portion;

a pair of armrests disposed on two sides of the base portion;

a backrest disposed on the base portion;

a uplifting apparatus disposed inside the base portion and comprising a pair of assist handles and a waist rest support, wherein the waist rest support is located at a side of the backrest, the pair of assist handles are located at inner sides of the pair of armrests, and the pair of assist handles are configured to protrude out of or retract back to the inner sides of the pair of armrests when the uplifting apparatus is activated; and a waist rest cushion disposed on the waist rest support, wherein the uplifting apparatus further comprises a base stand and a seat cushion support, wherein a first side of the seat cushion support is pivotally connected to the base stand, the waist rest support is connected to a second side of the seat cushion support, and the pair of assist handles are disposed at two sides of the waist rest support.

2. The assist chair according to claim 1, wherein the uplifting apparatus further comprises a push-retracting assembly and a pair of connecting rod assemblies, the pair of connecting rod assemblies are connected between the base stand and the waist rest support and located at the two sides of the waist rest support and at two sides of the base stand, and the push-retracting assembly is connected to the base stand and the seat cushion support and located between the pair of connecting rod assemblies.

3. An assist chair, comprising:

a base portion;

a pair of armrests disposed on two sides of the base portion;

a backrest disposed on the base portion;

a uplifting apparatus disposed inside the base portion and comprising a pair of assist handles and a waist rest support, wherein the waist rest support is located at a side of the backrest, the pair of assist handles are located at inner sides of the pair of armrests, and the pair of assist handles are configured to protrude out of or retract back to the inner sides of the pair of armrests when the uplifting apparatus is activated; and a waist rest cushion disposed on the waist rest support, wherein the uplifting apparatus further comprises a seat cushion support located by the backrest, the assist chair further comprises a seat cushion located on the seat cushion support, and the seat cushion is configured to lean away from the backrest when the pair of the assist handles are elevated.

4. The assist chair according to claim 3, wherein the pair of assist handles are configured to move away from the backrest when the seat cushion is leaning away from the backrest.

5. The assist chair according to claim 3, wherein the waist rest cushion is at a plane different from a plane of the seat cushion.

6. An assist chair, comprising:

a base portion;

a pair of armrests disposed on two sides of the base portion;

a backrest disposed on the base portion; and an uplifting apparatus disposed inside the base portion and comprising a pair of assist handles, wherein the pair of assist handles are located at inner sides of the pair of armrests, the pair of assist handles are configured to protrude out of or retract back to the inner sides of the pair of armrests when the uplifting apparatus is activated, and the pair of assist handles are configure to move away from the backrest when the pair of assist handles protrude out of the inner sides of the pair of armrests.

7. The assist chair according to claim 6, wherein the assist chair further comprises a seat cushions located at a side of the backrest and the seat cushion is configured to lean away from the backrest when the pair of assist handles move away from the backrest.

* * * * *